US010126066B2

(12) United States Patent
Pitts et al.

(10) Patent No.: US 10,126,066 B2
(45) Date of Patent: Nov. 13, 2018

(54) SIDE MOUNTED REFRIGERANT DISTRIBUTOR IN A FLOODED EVAPORATOR AND SIDE MOUNTED INLET PIPE TO THE DISTRIBUTOR

(71) Applicant: TRANE INTERNATIONAL INC., Piscataway, NJ (US)

(72) Inventors: Steven Joseph Pitts, La Crescent, MN (US); Harry Kenneth Ring, Houston, MN (US); Steven Erwin Meloling, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 379 days.

(21) Appl. No.: 14/777,330

(22) PCT Filed: Mar. 14, 2014

(86) PCT No.: PCT/US2014/028379

§ 371 (c)(1),
(2) Date: Sep. 15, 2015

(87) PCT Pub. No.: WO2014/144105

PCT Pub. Date: Sep. 18, 2014

(65) Prior Publication Data

US 2016/0025416 A1 Jan. 28, 2016

Related U.S. Application Data

(60) Provisional application No. 61/794,440, filed on Mar. 15, 2013.

(51) Int. Cl.
*F28F 9/22* (2006.01)
*F28D 7/00* (2006.01)
(Continued)

(52) U.S. Cl.
CPC ..... *F28D 7/0066* (2013.01); *F28D 7/16* (2013.01); *F25B 39/028* (2013.01); *F25B 2339/0242* (2013.01); *F28F 2009/224* (2013.01)

(58) Field of Classification Search
CPC ..... F25B 39/028; F25B 2339/0242; F28F 2009/224
(Continued)

(56) References Cited

U.S. PATENT DOCUMENTS 3,125,161 A * 3/1964 Romanos ..... F22B 1/021 165/159
3,286,482 A * 11/1966 Clark ..... F25B 41/06 62/218
(Continued)

FOREIGN PATENT DOCUMENTS

CN 101600918 A 12/2009
CN 102472589 A 5/2012
(Continued)

OTHER PUBLICATIONS

International Search Report and Written Opinion for International Application No. PCT/US2014/028379, dated Jun. 26, 2014, 13 pgs.

*Primary Examiner* — Leonard R Leo
(74) *Attorney, Agent, or Firm* — Hamre, Schumann, Mueller & Larson, P.C.

(57) ABSTRACT

A heat exchanger, for example a shell and tube flooded evaporator, has a refrigerant distributor that is positioned at an angle between the bottom of the shell and the sides of the shell, and includes an inlet that is welded to an inlet piping, where the inlet and inlet piping are in fluid communication with the refrigerant distributor, and are in a generally corresponding position orientation. Tubes of a tube bundles may extend proximate the bottom of the shell.

27 Claims, 7 Drawing Sheets

(51) Int. Cl.
*F28D 7/16* (2006.01)
*F25B 39/02* (2006.01)

(58) Field of Classification Search
USPC ..... 165/159, 160, 174
See application file for complete search history.

(56) References Cited

U.S. PATENT DOCUMENTS

| | | | | |
|---|---|---|---|---|
| 3,399,544 | A | 9/1968 | Osborne | |
| 3,405,536 | A | 10/1968 | Endress | |
| 3,499,296 | A * | 3/1970 | Osborne | F25B 41/06 62/115 |
| 3,789,617 | A | 2/1974 | Rannow | |
| 4,016,835 | A * | 4/1977 | Yarden | F28F 9/0265 165/159 |
| 5,782,293 | A * | 7/1998 | Sather | F28B 1/06 165/174 |
| 5,836,382 | A | 11/1998 | Dingle et al. | |
| 7,421,855 | B2 | 9/2008 | Ring et al. | |
| 2008/0149311 | A1 | 6/2008 | Liu et al. | |
| 2008/0163637 | A1 | 7/2008 | Ring et al. | |
| 2010/0326108 | A1 | 12/2010 | Schreiber et al. | |
| 2011/0017432 | A1 | 1/2011 | Kulankara et al. | |
| 2011/0226005 | A1* | 9/2011 | Lee | F25B 39/028 62/515 |
| 2012/0118545 | A1 | 5/2012 | Ayub et al. | |

FOREIGN PATENT DOCUMENTS

| | | | |
|---|---|---|---|
| CN | 102788451 | A | 11/2012 |
| CN | 102959346 | A | 3/2013 |
| TW | 200827651 | A | 7/2008 |

* cited by examiner

SIDE MOUNTED REFRIGERANT DISTRIBUTOR IN A FLOODED EVAPORATOR AND SIDE MOUNTED INLET PIPE TO THE DISTRIBUTOR

FIELD

Embodiments disclosed herein relate generally to a side mounted distributor inside a heat exchanger and to a side mounted inlet piping to access the distributor inside the heat exchanger. In particular, methods, systems and apparatuses are disclosed that employ a side mounted distributor and a side mounted inlet piping to access the distributor, and which may be used for example in a shell and tube heat exchanger, such as for example in a flooded evaporator of a fluid chiller.

BACKGROUND

A refrigeration or HVAC system would typically include a compressor, a condenser, an expansion device, and an evaporator that form a refrigerant circuit. Such a circuit can be embodied in what is known as a chiller.

Chillers for example can be used to cool a process fluid, such as water, where such process fluid can be directly used or may be used for various other cooling purposes, such as for example cooling a space. In a cooling cycle, refrigerant vapor is generally compressed by the compressor, and then condensed to liquid refrigerant in the condenser. The liquid refrigerant can then be directed through the expansion device to reduce a temperature and can become, at least in part, a liquid/vapor refrigerant mixture (two-phase refrigerant mixture). The refrigerant, e.g. including two-phase mixture, is directed into the evaporator to exchange heat with a fluid moving through the evaporator. The refrigerant mixture can be vaporized to refrigerant vapor in the evaporator, and the refrigerant vapor can then be returned to the compressor to repeat the refrigerant cycle.

The refrigerant can enter the evaporator by way of inlet piping into a distributor. When the evaporator is a shell and tube evaporator, the distributor can often reside inside the shell of the evaporator on the shell side, where the shell has an inlet or nozzle to access the distributor using the inlet piping. The distributor has openings so that the refrigerant can be distributed on the shell side of the evaporator and so that the refrigerant can exchange heat with a fluid passing through the inside of the tubes, which is known as the tube side, and where tubes are often constructed as a tube bundle. The fluid, which may be the process fluid such as for example water, can then be cooled in a cooling cycle of the evaporator.

One type of shell and tube evaporator is known as a flooded evaporator, where refrigerant is to enter at a bottom portion of the shell and where, depending on the operating condition of the chiller, tubes of the tube bundle may be wetted by the refrigerant flowing through the evaporator.

SUMMARY

As described above, one type of heat exchanger in a refrigeration or HVAC system is a shell and tube heat exchanger, which may operate as an evaporator and/or a condenser, depending on the operation mode. One or more of such shell and tube heat exchangers may be embodied in a chiller. One type of shell and tube evaporator is called a flooded evaporator. A flooded evaporator can be used for example, in large tonnage chillers, such as for example a centrifugal chiller to regulate refrigerant flow. It will be appreciated that the features, designs, and advantages of the side mounted refrigerant distributor and the side mounted inlet piping and inlet described herein can be applicable to shell and tube evaporators in general, and which may have refrigerant enter the bottom of the shell, e.g. a flooded evaporator. Centrifugal chillers can sometimes have compressors with relatively large diameters that are supported on top of the evaporator shell, which can cause the height constraint of, e.g. a chiller unit as a whole, such as for example impacting shipment of the unit in "one piece". There may also be height limitations/constraints for example when installing the chiller inside a building with ceiling clearance.

In a flooded evaporator, a tube bundle is immersed inside a shell and is at least in part "flooded" in liquid refrigerant, for example depending on the operating condition and/or load of for example the chiller in which the evaporator is employed or the overall refrigeration system. The tube bundles allow for heat transfer from the process or transfer fluid to the refrigerant surrounding the tubes. Refrigerant distributors are often located at the bottom of flooded evaporators to ensure sufficient tube flooding. At such a distributor location, the liquid inlet pipe to enter the shell is often at a bottom portion evaporator. Connecting the inlet pipe directly to the bottom of the evaporator increases the unit height which can exceed shipping height constraints. Also, locating the refrigerant distributor at the bottom can increase the refrigerant charge in the evaporator, rather than be displaced for example by other components such as additional heat exchange tubes.

In one embodiment, a heat exchanger, which may be a flooded evaporator, includes a shell and tube structure. The shell in general is a cylindrically shaped container with the bundle of tubes running longitudinally along the length of the shell.

In some embodiments, the heat exchanger is one component of the circuit of a refrigeration and/or HVAC system, and embodied in a chiller. In some embodiments, the chiller is a centrifugal chiller which may be a large tonnage centrifugal chiller.

Generally, a refrigerant distributor is positioned inside the shell on the shell side, and at a rotated position that is at an angle away from the bottom of the shell.

The refrigerant distributor in some embodiments is mounted to the shell wall. The position of the refrigerant distributor in some embodiments may be at an angle taken at a position away from the bottom of the shell. The angle can be defined as being between a radius taken from a point on the shell away from the bottom and a radius taken from the bottom.

In one exemplary embodiment only, the angle between the bottom of the shell and the side of the shell is roughly 45 degrees from the bottom, but it will be appreciated that the angle could be a different acute angle, e.g. less than 90 degrees, relative to the bottom of the shell.

In some embodiments, the angle could be slightly higher or slightly less than 45 degrees, or in other examples defined so that the distributor is positioned away from the bottom of the shell, but relatively closer to the bottom of the shell as compared to the horizontal diameter through the sides of the shell.

The shell of the heat exchanger also includes an inlet to allow refrigerant to enter the shell, where an inlet piping is mounted to the shell and in fluid communication with the shell inlet. In some embodiments, the shell inlet and the inlet piping are also positioned on a side of the shell at an angle away from the bottom of the shell. The shell inlet and the inlet piping can be disposed generally in a corresponding radial position on the shell as the refrigerant distributor to allow refrigerant to flow directly into the refrigerant distributor.

For example, as with the refrigerant distributor above, the angle between the bottom of the shell and the side of the shell can be roughly 45 degrees from the bottom, but it will be appreciated that the angle could be at a different acute angle, e.g. less than 90 degrees, relative to the bottom of the shell. In other embodiments, the angle could be slightly higher or slightly less than 45 degrees, or in other examples defined so that the shell inlet and inlet piping are positioned away from the bottom of the shell, but relatively closer to the bottom of the shell as compared to the horizontal diameter through the sides of the shell.

In some embodiments, the inlet piping includes an inlet axis that generally passes through a center area of the shell. In some embodiments, the inlet piping has a diameter, where a cross sectional area of the inlet piping across its diameter is generally tangent relative to an arc of the shell's circumference. The inlet piping can be welded to the shell in such an arrangement so as to obtain a full penetration weld.

In some embodiments, refrigerant can flow through the inlet of the shell into an opening or open space of the refrigerant distributor, which is arranged between a panel of the refrigerant distributor and the evaporator shell. Refrigerant can flow axially down the length of the refrigerant distributor in the longitudinal direction of the shell and enter the shell side for distribution near the bottom of the tube bundle.

In some embodiments, as a result of the location of the refrigerant distributor, the tube bundle may include tubes that can be located directly or at least proximately toward the bottom of the evaporator to obtain increased wettability and to provide displacement of refrigerant to obtain some relatively reduced refrigerant charge in the shell of the evaporator.

The orientation of the shell inlet and inlet piping can improve the ease of attachment of the inlet piping by allowing the pipe to be welded to the evaporator shell, for example as a full penetration weld joint according to standards set out, for example by the American Society of Mechanical Engineers (ASME), for its boiler and pressure vessels code (BPVC). The side connection for the inlet piping also limits the height of the entire unit, as there is no need to feed or pipe the refrigerant into the bottom of the shell.

At least in some operating conditions, the orientation of the distributor and the shell inlet and inlet piping can allow for suitable and/or improved flow velocity, flow turning, and entrance pressure drop, for example by limiting such velocities, flow turning, and pressure drop due to the arrangement and relatively smooth inlet into the shell.

DRAWINGS

These and other features, aspects, and advantages of the side mounted distributor will become better understood when the following detailed description is read with reference to the accompanying drawing, wherein.

While the above-identified figures set forth particular embodiments of the side mounted distributor and side mounted inlet piping, other embodiments are also contemplated, as noted in the discussion. In all cases, this disclosure presents illustrated embodiments of the side mounted distributor and side mounted inlet piping by way of representation but not limitation. Numerous other modifications and embodiments can be devised by those skilled in the art which fall within the scope and spirit of the principles of the side mounted distributor and side mounted inlet piping described herein.

DETAILED DESCRIPTION

Figure 1:
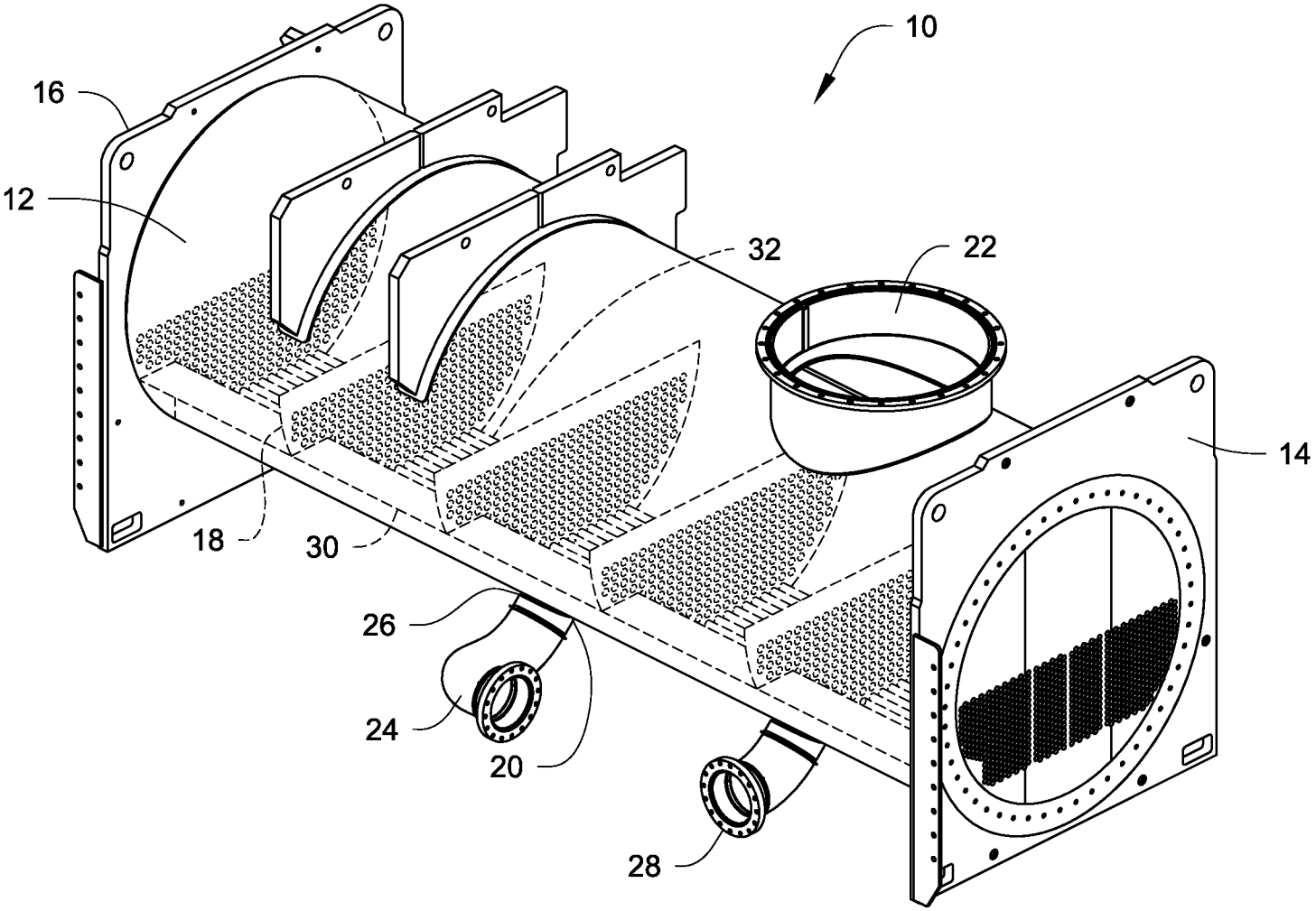
FIG. 1 is a perspective schematic view of a heat exchanger, which includes a side mounted refrigerant distributor and a side mounted inlet piping, according to one embodiment.
Figure 2:
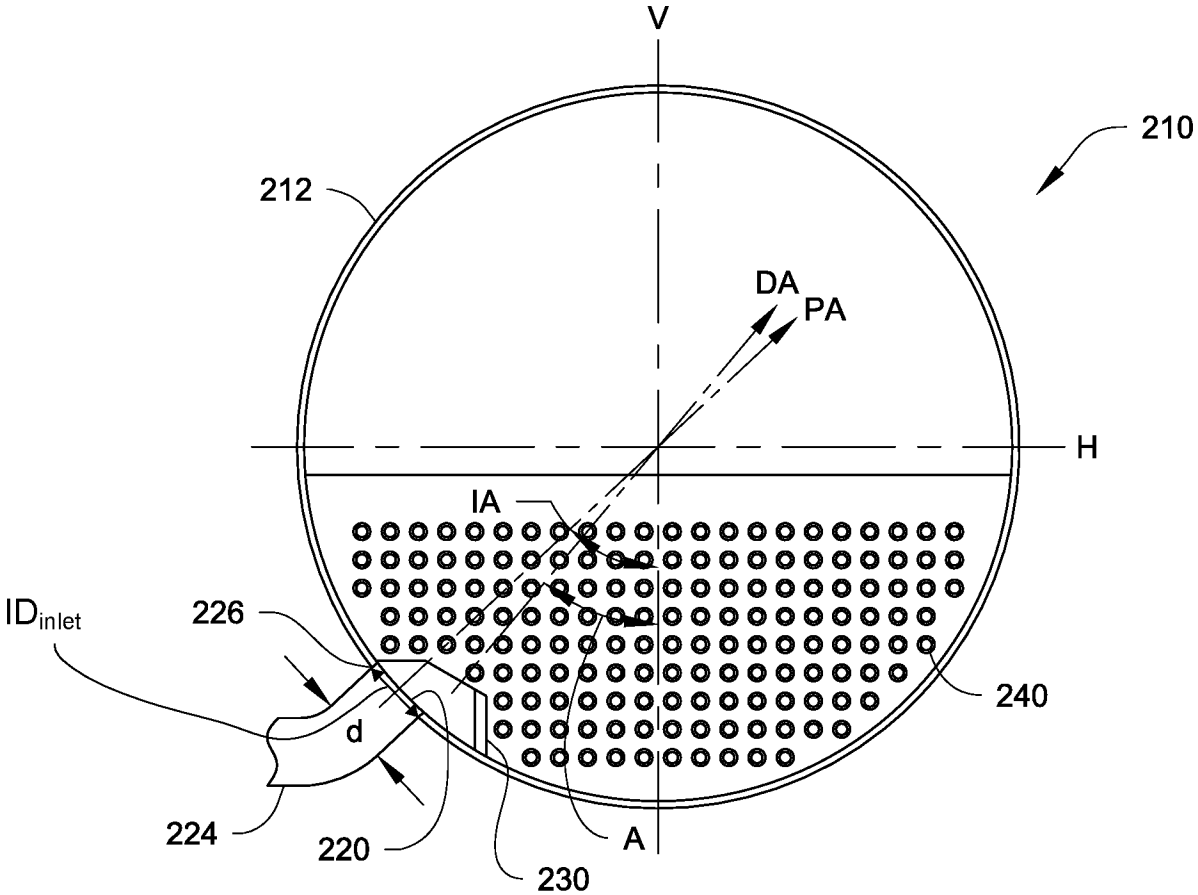
FIG. 2 is an end schematic view of a heat exchanger, which includes a side mounted refrigerant distributor and a side mounted inlet piping, according to one embodiment.

FIGS. 1 and 2 are schematic views of heat exchanger 10, 210, respectively, and each of which includes a side mounted refrigerant distributor 30, 230 and a side mounted inlet piping 24, 224, according to exemplary embodiments. In the depicted embodiments, the heat exchangers 10, 210 each are referred to as a flooded shell and tube evaporator, e.g. "evaporator". The evaporators 10, 210 may be implemented in various configurations of a HVAC or refrigeration system, and may be embodied within a chiller unit, which may be implemented in such systems. However, it will be appreciated that the features and inventive concepts of the side mounted refrigerant distributor and a side mounted inlet piping described herein can be applied to various other heat exchangers, which may be employed in countless configurations of an HVAC and/or refrigeration system.

Referring back to FIG. 1, the evaporator 10 includes a shell 12 and tube structure or tube bundle 32 (most tubes not shown for ease of illustration). In the embodiment shown, the shell 12 in general is a cylindrically shaped container where the bundle of tubes 32 would run longitudinally along the length of the shell 12. End plates 14 and 16 are disposed at the longitudinal ends of the shell 12. One or more tube sheets 18 are located inside the shell. The tube sheet(s) support the tube bundle 32 which may be inserted through the tube sheets 18 and the end plates 14, 16 along the longitudinal direction of the shell from end to end.

The evaporator 10 includes an inlet 20 to receive refrigerant, of which at least a portion may be as a two phase mixture. The inlet 20 is disposed on the side of the shell 12 at an angle relative to the bottom of the shell 12. The inlet 20 can be accessed by the inlet piping 24 that has an outlet 26 to be in fluid communication with the inlet 20.

A suction outlet 22 is disposed toward the top of the shell 12. The suction outlet allows refrigerant vapor resulting from the heat exchange of the entering refrigerant with the fluid running through the tubes of the tube bundle 32. The fluid running through the tubes may be a process fluid, such as for example water, which is cooled and piped to another area for use.

The evaporator 10 can also include an oil return outlet 28 disposed on the side of the shell 12.

With reference back to the refrigerant distributor 30, the refrigerant distributor is generally positioned inside the shell on the shell side, and at a rotated position that is at an angle away from the bottom of the shell.

With reference back to the arrangement and orientation of the shell inlet 20 and the inlet piping 24, generally the shell inlet 20 and the inlet piping 24 are also positioned on a side of the shell 12 at an angle away from the bottom of the shell 12. The shell inlet 20 and the inlet piping 24 can be disposed generally in a corresponding radial position on the shell 12 as the refrigerant distributor 30 to allow refrigerant to flow directly into the refrigerant distributor 30.

FIG. 2 shows one embodiment of an evaporator 210 that further details an exemplary arrangement and orientation of the refrigerant distributor 230, the shell inlet 220, and inlet piping 224, according to the above general principle. It will be appreciated that the evaporator 210 is a simplified illustration and does not show the end plates, tube sheets, suction outlet, oil return line, and other usual components that may be used in typical evaporators, for example flooded evaporators.

With reference back to FIG. 2, the refrigerant distributor 230 in some embodiments is mounted to the wall of the shell 212. As described, the position of the refrigerant distributor 230 in some embodiments may be at an angle A taken at a position away from the bottom of the shell, see line V passing through the bottom of the shell 212. The angle A can be defined as being between a radius taken from a point on the shell away from the bottom (see line DA) and a radius taken from the bottom (see along line V).

In one exemplary embodiment only, the angle A between the bottom of the shell 212 and the side of the shell 212 is roughly 45 degrees from the bottom, but it will be appreciated that the angle A could be a different acute angle, e.g. less than 90 degrees, relative to the bottom of the shell 212.

In some embodiments, the angle A could be slightly higher or slightly less than 45 degrees, or in other examples defined so that the refrigerant distributor 230 is positioned away from the bottom of the shell 212, but relatively closer to the bottom of the shell 212 as compared to the horizontal diameter (see line H) through the sides of the shell 212. As shown, the refrigerant distributor 230 is positioned on a side and at angle away from the bottom of the shell 212 but still closer to the bottom, as compared to line H.

The shell 212 also includes an inlet 220 to allow refrigerant to enter the shell 212, where an inlet piping 224 is mounted to the shell 212 and has an outlet 226 in fluid communication with the shell inlet 220. In some embodiments, the shell inlet 220 and the inlet piping 224 are also positioned on a side of the shell 212 at an angle IA away from the bottom of the shell 212 (see line PA). The shell inlet 220 and the inlet piping 224 can be disposed generally in a corresponding radial position on the shell 212 as the refrigerant distributor 230 to allow refrigerant to flow directly into the refrigerant distributor 230.

For example, as with the refrigerant distributor above, the angle IA between the bottom of the shell and the side of the shell can be roughly 45 degrees from the bottom, but it will be appreciated that the angle IA could be at a different acute angle, e.g. less than 90 degrees, relative to the bottom of the shell. In other embodiments, the angle IA could be slightly higher or slightly less than 45 degrees, or in other examples defined so that the shell inlet and inlet piping are positioned away from the bottom of the shell, but relatively closer to the bottom of the shell as compared to the horizontal diameter through the sides of the shell.

It will also be appreciated that while the inlet 220 and inlet piping 224 may arranged and oriented to be at the same angle A as the refrigerant distributor, due to the different sizing and dimension of these components, the inlet 220 and inlet piping 224 can be arranged and oriented at a slightly different angle (e.g IA) than that of the refrigerant distributor 230. For example, as shown in FIG. 2, the inlet piping 224 is at an angle (e.g. IA) relative to the bottom of the shell 212 as compared to the inlet 220 (e.g. A), where the inlet piping is relatively higher on the side of the shell 212 and relatively toward the top of the distributor 230.

In some embodiments, the inlet piping 224 includes an inlet axis (see line PA) that generally passes through a center area of the shell 212. In some embodiments, the inlet piping 224 has a diameter "d", where a cross sectional area of the inlet piping 224 across its diameter "d" is generally tangent relative to an arc of the shell's circumference. The inlet piping 224 can be welded to the shell 212, and aligned with the inlet 220, in such an arrangement so as to obtain a full penetration weld.

In some embodiments, refrigerant can flow through the inlet 220 of the shell 212 into an opening or open space of the refrigerant distributor 230, which is arranged between a panel of the refrigerant distributor 230 and the evaporator shell 212. Refrigerant can flow axially down the length of the refrigerant distributor 230 in the longitudinal direction of the shell and enter the shell side for distribution near the bottom of the tube bundle 240. See also FIG. 1 for the axial flow through the distributor into the shell in the longitudinal direction.

In some embodiments, such as shown in FIG. 2, as a result of the location of the refrigerant distributor 230, the tube bundle 240 may include tubes that can be located directly or at least proximately toward the bottom of the evaporator shell 212. This arrangement and structure can help to obtain increased wettability and to provide displacement of refrigerant to obtain some relatively reduced refrigerant charge in the shell 212 of the evaporator 210.

The orientation of the shell inlet 220 and inlet piping 224 can improve the ease of attachment of the inlet piping 224 by allowing the inlet piping 224 to be welded to the evaporator shell 212, for example as a full penetration weld joint according to standards set out, for example by the American Society of Mechanical Engineers (ASME), for its boiler and pressure vessels code (BPVC). The side connection for the inlet piping 224 also limits or saves on the height of the entire unit 210, as there is no need to feed or pipe the refrigerant into the bottom of the shell 212.

At least in some operating conditions, the orientation of the distributor 230 and the shell inlet 220 and inlet piping 224 can allow for suitable and/or improved flow velocity, flow turning, and entrance pressure drop, for example by limiting such velocities, flow turning, and pressure drop due to the arrangement and relatively smooth inlet into the shell 212.

It will be appreciated that the evaporator 10 of FIG. 1 can enjoy the same benefits described above with respect to FIG. 2.

Figure 5:
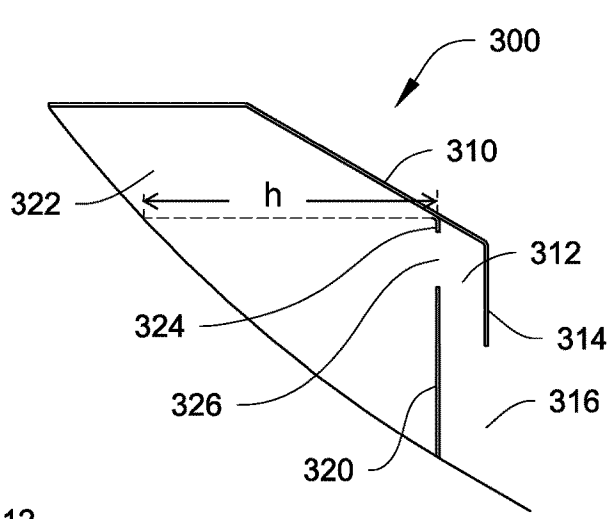
FIG. 5 is a side schematic view of the distributor of FIG. 3.
Figure 3:
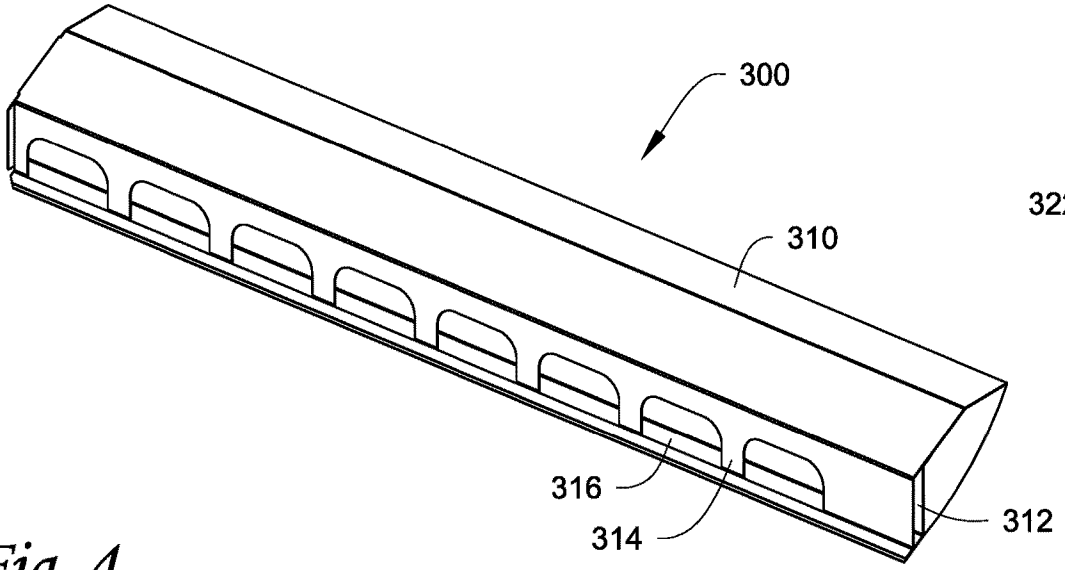
FIG. 3 is a perspective view of a distributor, according to one embodiment.
Figure 4:
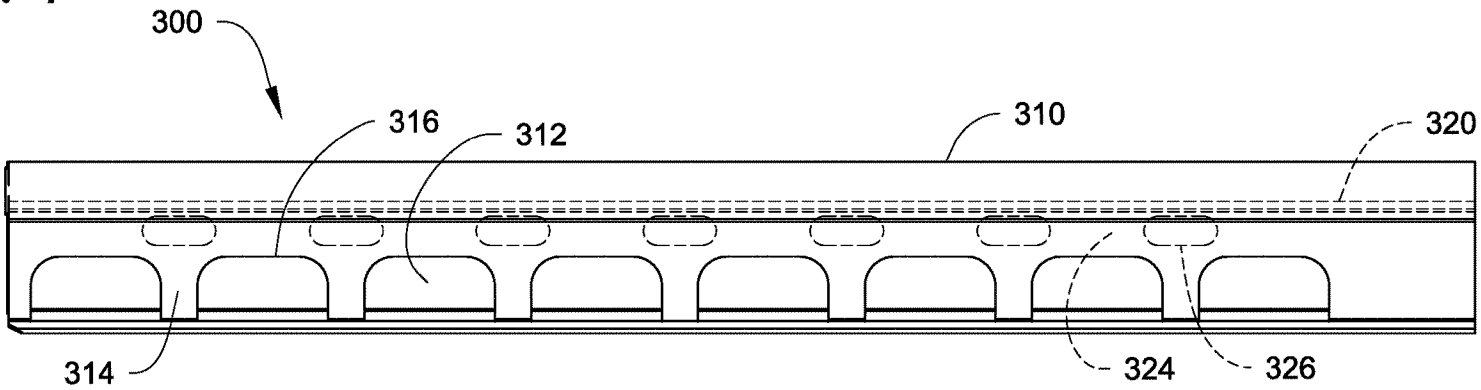
FIG. 4 is a longitudinal side view of the distributor of FIG. 3.

FIGS. 3 to 5 show views of a distributor 300 alone, according to one embodiment. FIG. 3 is a perspective view of the distributor 300. FIG. 4 is a longitudinal side view of the distributor 300 of FIG. 3. FIG. 5 is a side schematic view of the distributor of FIG. 3. It will be appreciated that the refrigerant distributor 300 may be implemented in the evaporators 10, 210, described above.

The distributor 300 has a baffle distribution component 310 with a panel structure that forms a cavity 312. The baffle distribution component 310 has several baffles 314 between which are orifices or openings 316 through which refrigerant may flow into the evaporator, e.g. 10, 210.

The distributor 300 also includes a main distribution component 320 with a panel structure that forms a cavity 322. The main distribution component 320 has several orifices or openings 326 through one of the panels 324, such as shown in FIG. 5. The main distribution component 320 may be arranged inside the baffle distribution component 310, such as shown in the profile view of FIG. 5 and the see through of FIG. 4.

It will be appreciated that the cavities 312, 322 may be formed by the panel structure of the baffle and main distribution components 310, 320, against a side of the shell, e.g. 12, 212, of the evaporator, e.g. 10, 210. However, it will be appreciated that the overall panel structure of the refrigerant distributor could be a closed structure at the bottom, so that the cavities 312, 322 are formed by a separately bound component.

In some embodiments, refrigerant flow through the refrigerant distributor 300 may be as follows. The main distribution component 320 receives refrigerant from the inlet, e.g. 20, 220, in its cavity 322 and allows the refrigerant to flow through the orifices 326 into the cavity 312 of the baffle distribution component 310. In the baffle distribution component 310, the refrigerant can flow through the orifices 316 through the baffles 314.

It will also be appreciated that the refrigerant distributor 300 may also have a trapped gas capability to help separate liquid refrigerant from vapor refrigerant. For example, in FIG. 5, the horizontal dashed straight line from panel 324 may illustrate that everything above this line can allow for trapped gas. Additionally, the cross section area of the refrigerant distributor 300 can be relatively smaller than traditional bottom distributors, and which can further reduce refrigerant charge in the shell, and allow more tubes to be placed in the given shell diameter. It will be appreciated that any of the features of refrigerant distributor 300 can be applicable to the distributors 30, 230 described above.

Figure 6:
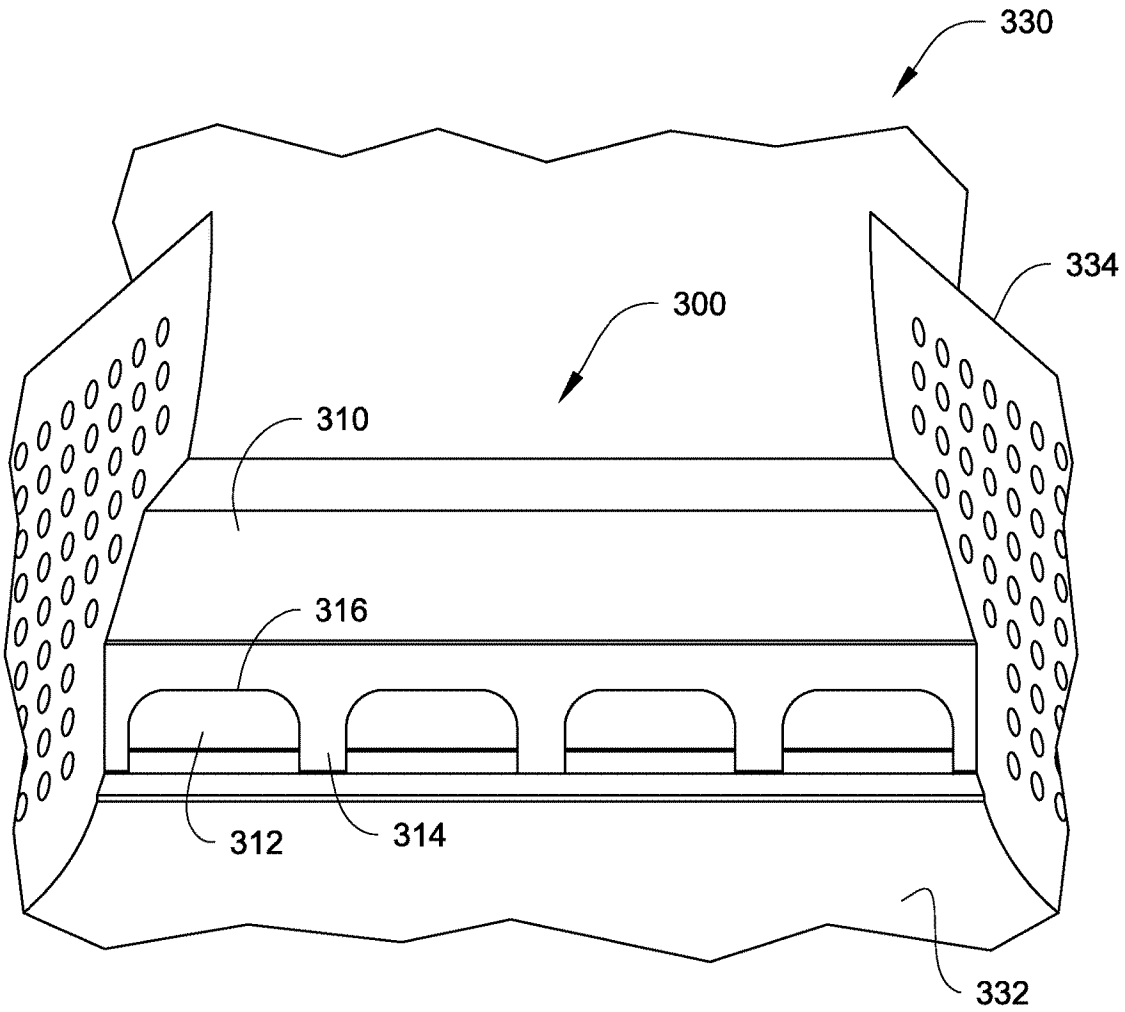
FIG. 6 is a top perspective view of a distributor according to one embodiment and shown assembled inside a shell of a heat exchanger.

FIG. 6 is a representation of the distributor 300 according to one embodiment and shown assembled inside a shell 332 of a heat exchanger, e.g. evaporator 330. It will be appreciated that FIG. 6 can be the refrigerant distributor 300. As shown, the shell 332 of the evaporator also has tube sheets 334 that also accommodate the location of the refrigerant distributor 300. As shown, the baffle distribution component is clearly shown with a portion of the cavity 312, baffles 314, and the orifices 316.

Figure 7:
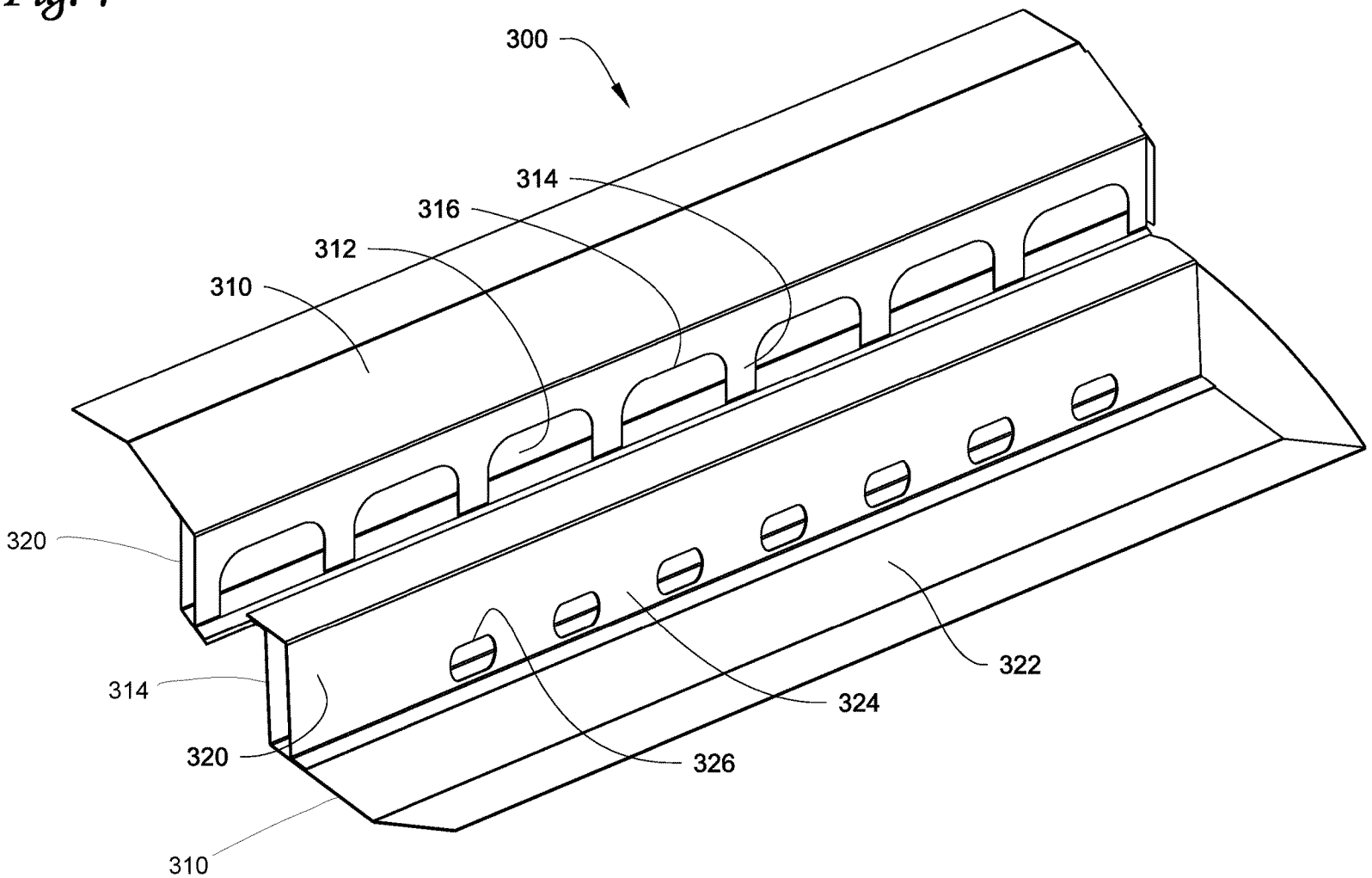
FIG. 7 illustrates two views of the distributor of FIG. 6 from different angles showing a main distribution component with first orifices and a baffle distribution component with second orifices, according to one embodiment.

FIG. 7 illustrates two views of the distributor 300 of FIG. 6 from different angles. The lower portion of FIG. 7 illustrates the distributor 300 at an angle showing the main distribution component 320 having the wall 324 with first orifices 326 extending therethrough, and showing the panel structure of the main distribution component 320 making up part of the space for the cavity 322. The upper portion of FIG. 7 illustrates the distributor 300 at an angle showing the baffle distribution component 310 with its baffles 314 and orifices 316, and showing a portion of the cavity 312.

Figure 8:
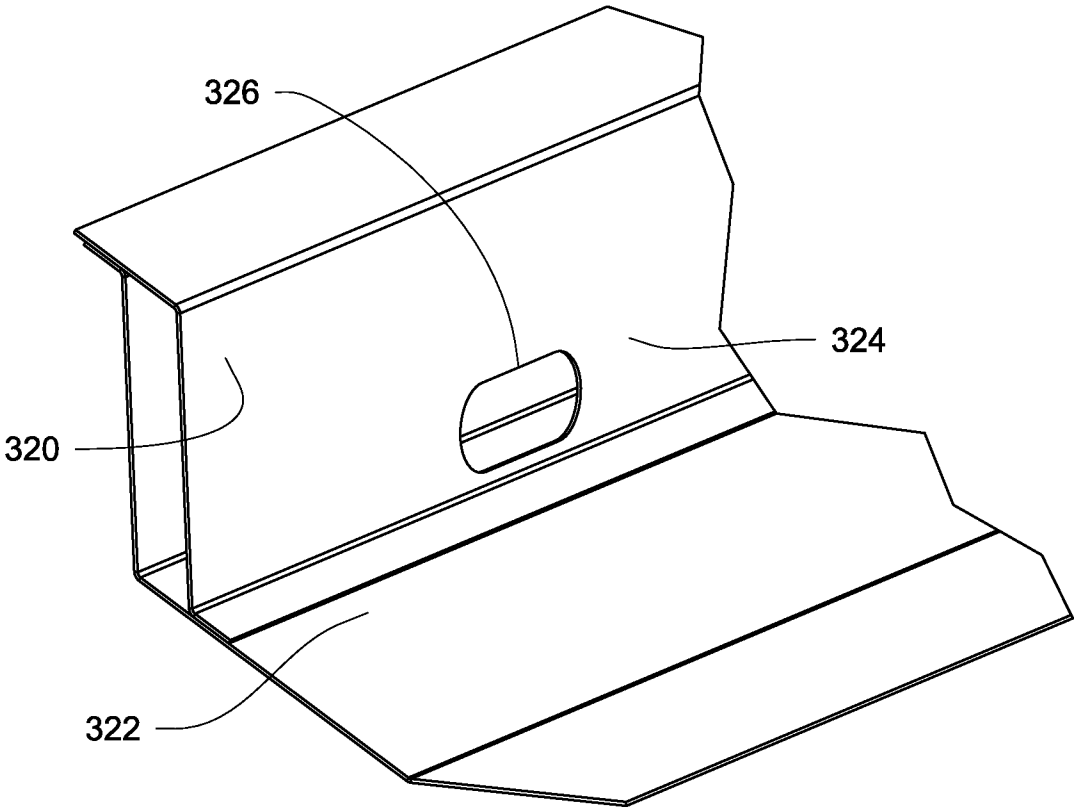
FIG. 8 is a partial side perspective view of the main distribution component shown in FIG. 7.

FIG. 8 is a partial side perspective view of the main distribution component 310 shown in FIG. 7, where like elements are labeled.

Figure 9:
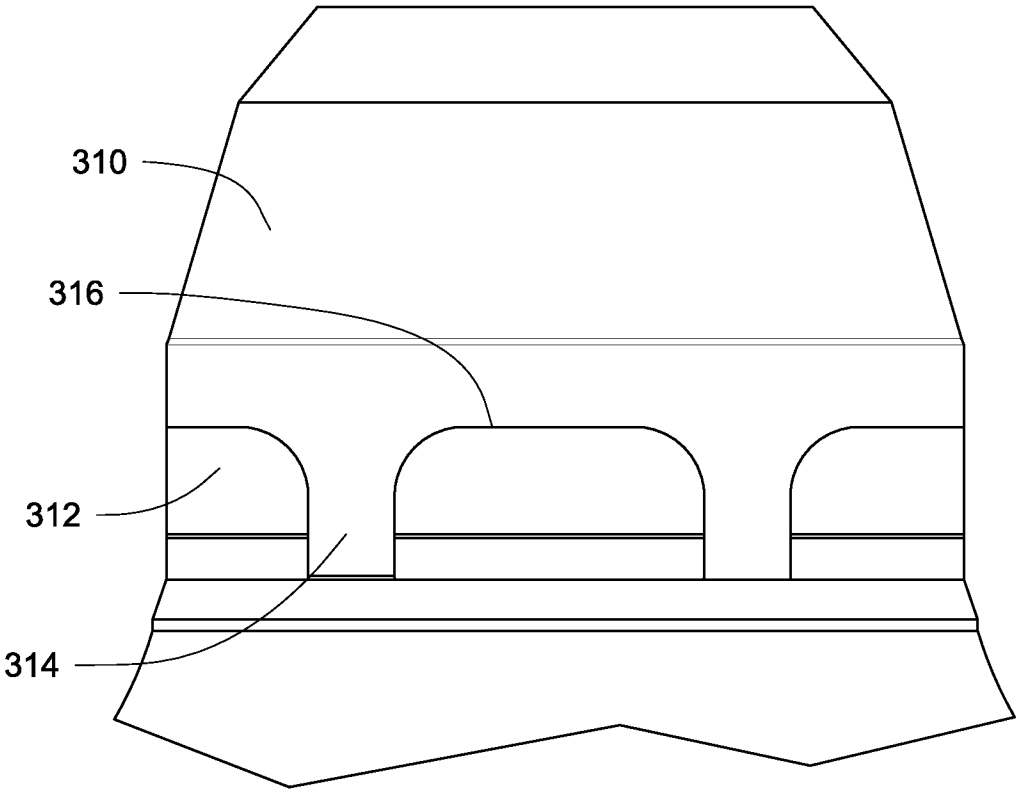
FIG. 9 is a partial side view of the baffle distribution component shown in FIG. 7.

FIG. 9 is a partial side view of the baffle distribution component shown in FIG. 7, where like elements are labeled.

Referring back to FIG. 1 as an example, two-phase flow can exit the low side inlet piping 24 and enter the shell 12 through, for example a radial nozzle or inlet 20 on the shell 12. In some embodiments, the position of the inlet piping 24 and inlet 20 can be at an axial position, such as for example at about a middle of the shell's length in the longitudinal direction. It will be appreciated, however, that the axial placement of the inlet 20 and inlet piping 24 could vary depending on the need and/or desire.

In some embodiments, the radial position on the shell wall can be as close to the bottom of the shell 12 as the general assembly constraints allow, e.g. height constraints as it may pertain to unit shipping.

With respect to the refrigerant flow through the refrigerant distributor 30, the flow can enter a chamber, cavity of the refrigerant distributor 30, which is arranged in the longitudinal direction of the shell 12, and can split into two flows toward the end plates 14, 16.

In some embodiments regarding the cavity, e.g. 322, a minimum depth "h" from the back side of the panel of the refrigerant distributor 300 to the inlet, e.g. 20, can be approximately $h=0.50\times ID_{inlet}$. This dimension could be for example from the back of wall 324 of refrigerant distributor 300 to the inlet on the shell, e.g. 20 on 12 from FIG. 1. See also e.g. dashed straight line from panel 324 in FIG. 5. In some cases, if the h/ID is less than 50%, the pressure drop of the flow entering the header could become too high. If the h/ID is much greater than 50% the header volume and cross sectional flow area will be too large.

As described, the refrigerant distributors herein have a series of distribution orifices, slots, or openings along the top of the header, e.g. the main distribution component 310, that are sized to distribute the flow axially along the length of the shell. It will be appreciated that in some cases, there would be no orifices 326 placed directly in front of the inlet nozzle, e.g. 20. In some examples, the arrangement may be such that there is a dimension of about $1.5\times ID_{inlet}$ from each side of the inlet, e.g. 20 to the first distribution orifice 326. In some examples, there may be 2 or 3 orifices per internal tube support span.

The velocity of the flow leaving the distribution orifices, e.g. 326 may be relatively high. For example, velocities greater than 15 ft/sec could be high enough to be tube vibration concerns. Baffle distribution component, e.g. 310, can help address this issue. The baffle distribution component with its chamber or cavity, e.g. 312, can have a cross sectional area equal to about one main distribution orifice, e.g. 326.

The baffle distribution component has its orifices, e.g. 316, which may be arranged at sides of the main distribution orifices, e.g. 326 (see FIG. 4 for example). These secondary orifices, e.g. 316, can be about two times the flow area of the main distribution orifices, e.g. 326. With such an arrangement, the refrigerant flow can enter the shell and the bottom of the tube bundle at a velocity of less than 15 ft/sec.

With respect to how close tubes of the tube bundle may be placed relative to the shell, the clearance between the tubes and the distribution system components and shell could be small to minimize refrigerant charge, e.g. about ½ inch to tube tangent.

Clearance velocities in the pool section of the evaporator to allow for some self distribution of liquid to the high heat flux portion of the bundle may be targeted at about 4 to 6 ft/sec, such as for example for low pressure refrigerants. Velocities higher than this may carry more vapor than liquid in the pool region and not promote liquid self distribution. Lower velocities than this may impact the refrigerant charge.

It will also be appreciated that a water box configuration and position can accommodate the relatively lower positioned tubes, and also be mounted on the tube sheet low enough.

It will be appreciated that the components may be sized such that a main pressure drop, e.g. 50% to 55% of the system or unit is at the inlet of the shell. Two-phase velocities in such a system may be designed to increase through each component up to the main distribution orifices, e.g. 326. In this way large accelerations or decelerations of flow may be avoided, as well as bubble collapse/cavitations.

Aspects—any of aspects 1 to 28 may be combined with any of aspects 29 to 32, and any of aspects 29 to 31 may be combined with aspect 32.

1. A heat exchanger for a heating, ventilation, and air conditioning (HVAC) unit, comprising: a shell; a tube bundle inside the shell; a refrigerant distributor inside the shell; a refrigerant inlet through the shell and in fluid communication with the refrigerant distributor; and a refrigerant inlet piping mounted on the shell and in fluid communication with the refrigerant inlet; the refrigerant inlet is positioned on a side of the shell at an angle away from the bottom of the shell, and the refrigerant inlet piping is positioned on a side of the shell at an angle away from the bottom of the shell.

2. The heat exchanger of aspect 1, wherein the heat exchanger is configured as a flooded evaporator.

3. The heat exchanger of aspect 1 or 2, wherein the angle of the position of the refrigerant inlet and the refrigerant inlet piping being defined between a radius taken from a point on the shell away from the bottom of the shell and a radius taken from the bottom of the shell.

4. The heat exchanger of any of aspects 1 to 3, wherein the angle of the position of the refrigerant inlet and the refrigerant inlet piping is an acute angle relative to the bottom of the shell.

5. The heat exchanger of any of aspects 1 to 4, wherein the angle of the position of the refrigerant inlet and the refrigerant inlet piping between the bottom of the shell and the side of the shell is from about 45 degrees to less than 90 degrees.

6. The heat exchanger of any of aspects 1 to 5, wherein the angle of the position of the refrigerant inlet and the refrigerant inlet piping between the bottom of the shell and the side of the shell is positioned to be relatively closer to the bottom of the shell than an angle of a horizontal diameter of the shell to the bottom of the shell.

7. The heat exchanger of any of aspects 1 to 6, wherein the refrigerant inlet piping includes an inlet axis that generally passes through a center of the shell through a vertical axis and horizontal axis.

8. The heat exchanger of any of aspects 1 to 7, wherein the refrigerant inlet piping has a diameter, where a cross sectional area of the refrigerant inlet piping across its diameter is generally tangent relative to an arc of the circumference of the shell.

9. The heat exchanger of any of aspects 1 to 8, wherein the refrigerant inlet and the refrigerant inlet piping are each arranged and oriented to be at the same angle or are arranged and oriented at different angles.

10. The heat exchanger of any of aspects 1 to 9, wherein the angle of the refrigerant inlet piping is at an angle relative to the bottom of the shell that is relatively higher than the angle of the refrigerant inlet relative to the bottom of the shell.

11. The heat exchanger of any of aspects 1 to 10, wherein the inlet piping is welded to the shell as a full penetration weld suitable for boiler and pressure vessels.

12. The heat exchanger of any of aspects 1 to 11, wherein the refrigerant inlet and the refrigerant inlet piping have an axial position relative to a longitudinal direction of a length of the shell, the axial position defined as at about a middle position along the length of the shell.

13. The heat exchanger of any of aspects 1 to 12, wherein the tube bundle includes tubes disposed proximate the bottom of the shell, where the refrigerant distributor is not between a bottom row of tubes and the bottom of the shell.

14. The heat exchanger of any of aspects 1 to 13, wherein the tube bundle includes tubes disposed proximate the bottom of the shell, where a clearance from the shell and a tangent of the tubes is about half an inch.

15. The heat exchanger of any of aspects 1 to 14, wherein the refrigerant distributor is at a position on a side of the shell, and at an angle away from the bottom of the shell, the angle being defined between a radius taken from a point on the shell away from the bottom of the shell and a radius taken from the bottom of the shell.

16. The heat exchanger of aspect 15, wherein, as to the position of the refrigerant distributor, the angle between the bottom of the shell and the side of the shell is an acute angle.

17. The heat exchanger of aspect 15 or 16, wherein, as to the position of the refrigerant distributor, the angle between the bottom of the shell and the side of the shell is from about 45 degrees to less than 90 degrees.

18. The heat exchanger of any of aspects 15 to 17, wherein, as to the position of the refrigerant distributor, the angle between the bottom of the shell and the side of the shell is positioned to be relatively closer to the bottom of the shell than an angle of a horizontal diameter of the shell to the bottom of the shell.

19. The heat exchanger of any of aspects 15 to 18, wherein the refrigerant distributor comprises: a baffle distribution component with a panel structure that forms a cavity, the baffle distribution component has baffles between which are openings in fluid communication with the cavity; a main distribution component with a panel structure that forms a cavity, the main distribution component has openings through the panel structure and in fluid communication with the cavity of the main distribution component, the main distribution component is arranged inside the baffle distribution component, where the openings of the main distribution component are in fluid communication with the cavity of the baffle distribution component, and where the cavities and openings allow refrigerant to flow into the heat exchanger.

20. The heat exchanger of aspect 19, wherein the panel structure of the refrigerant distributor is suitably configured to include a trapped gas capability at an upper portion of the cavity inside the main distribution component and bound by the panel structures of both the baffle distribution component and the main distribution component.

21. The heat exchanger of aspect 19 or 20, wherein the cavity of the main distribution component has a minimum depth h, defined to be approximately $h=0.50(ID_{inlet})$, and where h is defined from a back of a panel of the main distribution component to the refrigerant inlet of the shell, and $ID_{inlet}$ is the inner diameter of the refrigerant inlet.

22. The heat exchanger of any of aspects 19 to 21, wherein the openings of the main distribution component are not directly in front of the refrigerant inlet.

23. The heat exchanger of any of aspects 19 to 22, wherein the openings of the main distribution component are arranged to be a dimension of about 1.5($ID_{inlet}$) from each side of the refrigerant inlet.

24. The heat exchanger of any of aspects 19 to 23, wherein the openings of the baffle distribution component are arranged relatively to the sides of the openings of the main distribution component.

25. The heat exchanger of any of aspects 19 to 24, wherein the openings of the baffle distribution component have about two times larger flow area relative to the openings of the main distribution component.

26. The heat exchanger of any of aspects 19 to 25, wherein the arrangement of the openings of the baffle distribution component and the openings of the main distribution component allow refrigerant flow to enter the shell at a velocity of less than 15 ft/sec.

27. The heat exchanger of any of aspects 1 to 26, wherein the heat exchanger is configured to allow for clearance velocities in a pool section of the heat exchanger to be about 4 to 6 ft/sec, so as to allow for self-distribution of liquid in the heat exchanger.

28. The heat exchanger of any of aspects 1 to 27, wherein the heat exchanger is configured to allow 50% to 55% pressure drop at the refrigerant inlet relative to an HVAC system in which the heat exchanger is installed.

29. An HVAC unit comprising the heat exchanger of any of aspects 1 to 28.

30. The HVAC unit of aspect 29, wherein the unit is a chiller.

31. The HVAC unit of aspect 29 or 30, wherein the chiller is a centrifugal chiller.

32. A method of refrigerant flow of a heat exchanger, comprising: directing refrigerant through a refrigerant inlet piping; directing the refrigerant from the refrigerant inlet piping to a refrigerant inlet of a shell of a heat exchanger; directing the refrigerant from the inlet into the shell; directing the refrigerant through a refrigerant distributor; and directing the refrigerant to contact tubes inside the shell to promote heat exchange of the refrigerant with a fluid passing through the tubes, wherein directing the refrigerant includes the refrigerant flowing through the refrigerant inlet piping that is positioned on a side of the shell at an angle away from the bottom of the shell, and the refrigerant flowing through the refrigerant inlet that is positioned on a side of the shell at an angle away from the bottom of the shell.

While the embodiments have been described in terms of various specific embodiments, those skilled in the art will recognize that the embodiments can be practiced with modification within the spirit and scope of the claims.

The invention claimed is:

1. A heat exchanger for a heating, ventilation, and air conditioning (HVAC) unit, comprising:

a shell;

a tube bundle inside the shell;

a refrigerant distributor inside the shell;

a refrigerant inlet through the shell and in fluid communication with the refrigerant distributor; and a refrigerant inlet piping mounted on the shell and in fluid communication with the refrigerant inlet, the refrigerant inlet is positioned on a side of the shell at an angle away from the bottom of the shell, the refrigerant inlet piping is positioned on a side of the shell at an angle away from the bottom of the shell, wherein the refrigerant distributor comprises a baffle distribution component having a panel, the baffle distribution component having baffles between which are openings in fluid communication with a first cavity; and a main distribution component having a panel, the main distribution component having openings through the panel of the main distribution component and in fluid communication with a second cavity, the panel of the main distribution component and the baffles of the baffle distribution component forming the first cavity, the panel of the main distribution component and the panel of the baffle distribution component forming the second cavity, the main distribution component is arranged inside the baffle distribution component, where the openings of the main distribution component are in fluid communication with the first cavity, and where the first and second cavities and the openings of the baffle distribution component and the openings of the main distribution component allow refrigerant to flow into the heat exchanger.

2. The heat exchanger of claim 1, wherein the heat exchanger is configured as a flooded evaporator.

3. The heat exchanger of claim 1, wherein the angle of the position of the refrigerant inlet and the refrigerant inlet piping being defined between a radius taken from a point on the shell away from the bottom of the shell and a radius taken from the bottom of the shell.

4. The heat exchanger of claim 1, wherein the angle of the position of the refrigerant inlet and the refrigerant inlet piping is an acute angle relative to the bottom of the shell.

5. The heat exchanger of claim 1, wherein the angle of the position of the refrigerant inlet and the refrigerant inlet piping between the bottom of the shell and the side of the shell is from about 45 degrees to less than 90 degrees.

6. The heat exchanger of claim 1, wherein the angle of the position of the refrigerant inlet and the refrigerant inlet piping between the bottom of the shell and the side of the shell is positioned to be relatively closer to the bottom of the shell than an angle of a horizontal diameter of the shell to the bottom of the shell.

7. The heat exchanger of claim 1, wherein the refrigerant inlet piping includes an inlet axis that generally passes through a center of the shell through a vertical axis and horizontal axis.

8. The heat exchanger of claim 1, wherein the refrigerant inlet piping has a diameter, where a cross sectional area of the refrigerant inlet piping across its diameter is generally tangent relative to an arc of the circumference of the shell.

9. The heat exchanger of claim 1, wherein the refrigerant inlet and the refrigerant inlet piping are each arranged and oriented to be at the same angle or are arranged and oriented at different angles.

10. The heat exchanger of claim 1, wherein the angle of the refrigerant inlet piping is at an angle relative to the bottom of the shell that is relatively higher than the angle of the refrigerant inlet relative to the bottom of the shell.

11. The heat exchanger of claim 1, wherein the inlet piping is welded to the shell as a full penetration weld.

12. The heat exchanger of claim 1, wherein the refrigerant inlet and the refrigerant inlet piping have an axial position relative to a longitudinal direction of a length of the shell, the axial position defined as at about a middle position along the length of the shell.

13. The heat exchanger of claim 1, wherein the tube bundle includes tubes disposed proximate the bottom of the shell, where a clearance from the shell and a tangent of the tubes disposed proximate the bottom of the shell is about half an inch.

14. The heat exchanger of claim 1, wherein the refrigerant distributor is at a position on a side of the shell, and at an angle away from the bottom of the shell, the angle being defined between a radius taken from a point on the shell away from the bottom of the shell and a radius taken from the bottom of the shell.

15. The heat exchanger of claim 14, wherein, as to the position of the refrigerant distributor, the angle between the bottom of the shell and the side of the shell is an acute angle.

16. The heat exchanger of claim 14, wherein, as to the position of the refrigerant distributor, the angle between the bottom of the shell and the side of the shell is from about 45 degrees to less than 90 degrees.

17. The heat exchanger of claim 14, wherein, as to the position of the refrigerant distributor, the angle between the bottom of the shell and the side of the shell is positioned to be relatively closer to the bottom of the shell than an angle of a horizontal diameter of the shell to the bottom of the shell.

18. The heat exchanger of claim 1, wherein a panel structure of the refrigerant distributor is configured to include a trapped gas capability at an upper portion of the second cavity.

19. The heat exchanger of claim 1, wherein the second cavity has a minimum depth h, defined to be approximately h=0.50 times $ID_{inlet}$, and where h is defined from a back of the panel of the main distribution component to the refrigerant inlet of the shell, and $ID_{inlet}$ is the inner diameter of the refrigerant inlet.

20. The heat exchanger of claim 1, wherein the openings of the main distribution component are not directly in front of the refrigerant inlet.

21. The heat exchanger of claim 1, wherein the openings of the main distribution component are arranged to be a dimension of about 1.5 times $ID_{inlet}$ from the refrigerant inlet and on each side of the refrigerant inlet, where $ID_{inlet}$ is the inner diameter of the refrigerant inlet.

22. The heat exchanger of claim 1, wherein the openings of the baffle distribution component are arranged relatively close to the sides of the openings of the main distribution component.

23. The heat exchanger of claim 1, wherein the openings of the baffle distribution component have about two times larger flow area relative to the openings of the main distribution component.

24. The heat exchanger of claim 1, wherein the arrangement of the openings of the baffle distribution component and the openings of the main distribution component allow refrigerant flow to enter the shell at a velocity of less than 15 ft/sec.

25. The heat exchanger of claim 1, wherein the heat exchanger is configured to allow for clearance velocities in a pool section of the heat exchanger to be about 4 to 6 ft/sec, so as to allow for self-distribution of liquid in the heat exchanger.

26. The heat exchanger of claim 1, wherein the heat exchanger is configured to allow 50% to 55% pressure drop at the refrigerant inlet relative to an HVAC system in which the heat exchanger is installed.

27. A heat exchanger for a heating, ventilation, and air conditioning (HVAC) unit, comprising:

a shell;

a tube bundle inside the shell;

a refrigerant distributor inside the shell;

a refrigerant inlet through the shell and in fluid communication with the refrigerant distributor; and a refrigerant inlet piping mounted on the shell and in fluid communication with the refrigerant inlet, wherein the refrigerant inlet is positioned on a side of the shell at an angle away from the bottom of the shell, the refrigerant inlet piping is positioned on a side of the shell at an angle away from the bottom of the shell, the refrigerant distributor comprises a baffle distribution component with a panel structure that forms a first cavity, the baffle distribution component having baffles between which are openings in fluid communication with the first cavity; and a main distribution component with a panel structure that forms a second cavity, the main distribution component having openings through the panel structure and in fluid communication with the second cavity, wherein the main distribution component is arranged inside the baffle distribution component, where the openings of the main distribution component are in fluid communication with the first cavity, and where the first and second cavities and the openings of the baffle distribution component and the openings of the main distribution component allow refrigerant to flow into the heat exchanger, and the tube bundle includes tubes disposed proximate the bottom of the shell, where the refrigerant distributor is not between a bottom row of tubes and the bottom of the shell.

* * * * *